United States Patent [19]

Yagi et al.

[11] 4,044,544

[45] Aug. 30, 1977

[54] ELECTRONIC TIMEPIECE

[75] Inventors: Kenjiro Yagi, Tokyo; Kazuhiro Asano, Chiba, both of Japan

[73] Assignee: Kabushiki Kaisha Daini Seikosha, Japan

[21] Appl. No.: 653,621

[22] Filed: Jan. 29, 1976

[30] Foreign Application Priority Data

Feb. 5, 1975 Japan ..... 50-15134

[51] Int. Cl.[2] ..... G04B 27/08; G04C 3/00

[52] U.S. Cl. ..... 58/23 R; 58/50 R; 58/85.5; 58/152 B

[58] Field of Search ..... 58/23 R, 50 R, 85.5, 58/152 B

[56] References Cited

U.S. PATENT DOCUMENTS 3,913,312 10/1975 Numabe ..... 58/50 R 3,925,978 12/1975 Naito ..... 58/23 R 3,953,964 5/1976 Suppa et al. ..... 58/50 R

*Primary Examiner*—Stanley J. Witkowski

*Attorney, Agent, or Firm*—Robert E. Burns; Emmanuel J. Lobato; Bruce L. Adams

[57] ABSTRACT

An electronic timepiece of the type having a display and a time-correcting switch for effecting correction of the displayed time is provided with a safety switch for enabling and disenabling the time-correcting switch. Whenever the safety switch is switched so as to enable the time-correcting switch, the displayed time on the display panel flashes at one second intervals thereby providing a visual indication of the enabled state of the time-correcting switch to thereby alert the timepiece user that actuation of the time-contacting switch will effect a time correction.

6 Claims, 2 Drawing Figures

FIG. 1
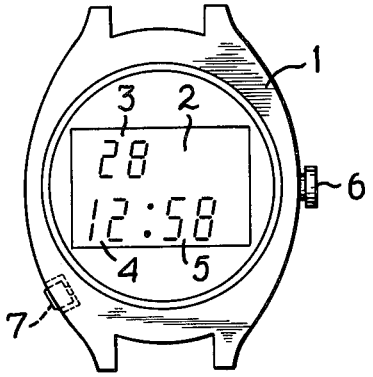
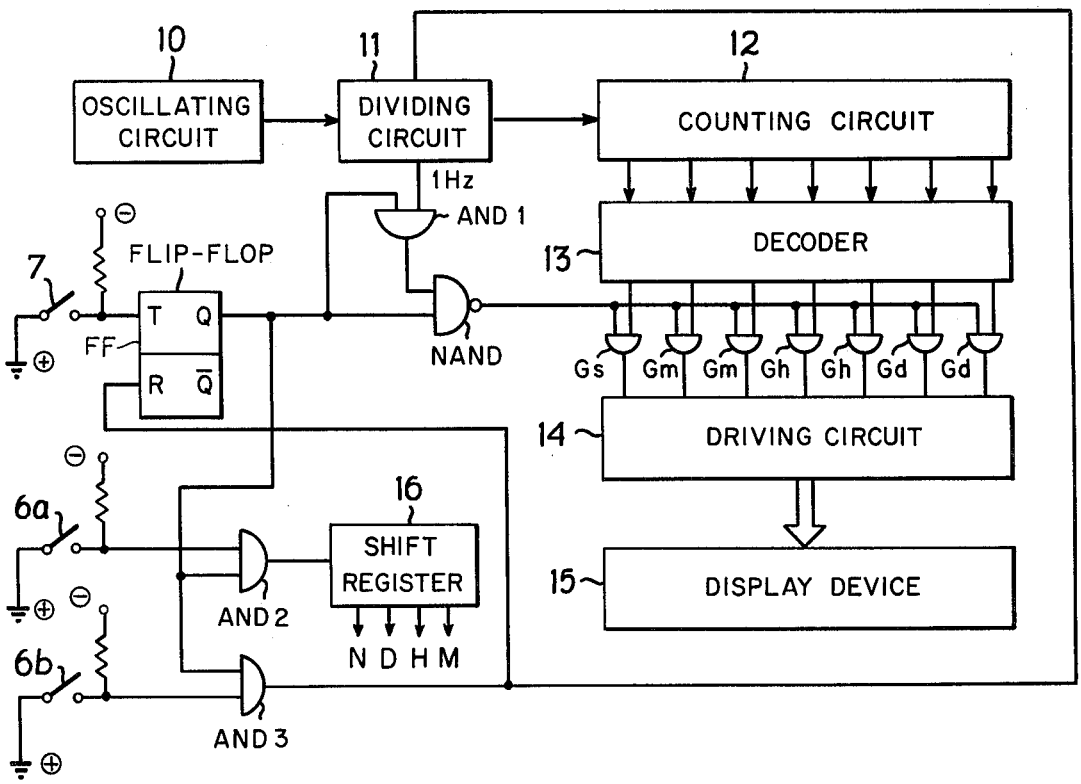
FIG. 2

ELECTRONIC TIMEPIECE

BACKGROUND OF THE INVENTION

This invention relates to electronic timepieces, and more particularly, to electronic timepieces having means for indicating when the safety switch has been actuated to thereby alert the operator that actuation of the time-correcting switch will effect a time correction.

In a timepiece which displays the time by means of liquid crystal or solid display elements one or more manual operating members employed for correcting or amending the displayed time such that actuation of the operating members changes the memorized contents of the electronic circuitry or the display contents of the display. The manual operating member has to be easily accessible to permit easy operation and safety means are usually provided for eliminating accidental operation. In the conventional safety means, the manual operating member coacts with a safety system so that either pulling the timepiece stem or pushing the stem releases the safety.

In the system of pulling stem, the number of parts forming the timepiece movement are increased whereby it is very difficult to obtain a small sized timepiece and to maintain cost down. On the other hand, in the system of pushing the stem, it is difficult to eliminate accidental or inadvertent operation.

To avoid these drawbacks, it has been proposed to mount the safety operational member in a recessed portion of the timepiece casing for eliminating or minimizing accidental operation thereof however, such has not proven satisfactory because the safety function is released by the outer factors, further it is very difficult to distinguish whether the safety operational member is released or not especially with small sized timepieces

SUMMARY OF THE INVENTION

This invention relates to an electronic timepiece having means for changing the display condition of at least one part of the displayed data appearing on the display device when the safety function is released to thereby alert the operator that the safety has been released.

BRIEF DESCRIPTION OF DRAWINGS

FIG. 1 is a front view of the electronic wrist watch of the present invention, and FIG. 2 is a block diagram of the electronic wristwatch in FIG. 1.

DETAILED DESCRIPTION OF THE INVENTION

FIG. 1 shows a front plan view of an electronic wristwatch embodying the invention and having a timepiece casing 1 with a display panel 2. The date, hour and minute display portions 3, 4 and 5 are respectively formed on the face of the display panel 2. A manually actuated function switch 6 comprised of a selection switch 6*a* and a resetting switch 6*b* for correcting or amending time and a manually depressable safety switch 7 for enabling and disenabling the function switch 6 are mounted on the peripheral wall of the timepiece casing 1. The safety switch 7 is mounted within a recess in the timepiece casing 1 such that the safety function is lost by pushing or actuating the safety switch 7. The figure selection, fast forward and resetting of the display contents are attained by operation of the function switch 6.

FIG. 2 shows a block diagram of the electronic timepiece which includes an oscillating circuit 10 for generating a high frequency output signal of 32,768 HZ which is divided to 1 second signals by a dividing circuit 11. The divided signal is applied to a counter circuit 12 having second, minute, hour and date counters. The counting signals of said counter circuit 12 are applied to a decoder 13 and are converted to analogue signals of second, minute, hour and date which are applied to a driving circuit 14 via AND-gates Gs, Gm, Gm, Gh, Gh, Gd and Gd thereby driving the display device 15 to display in the normal display mode the date, hour and minute displays.

A reset type trigger flip flop circuit FF is set by turning on the of said safety switch 7 whereby the Q-output of the flip-flop FF is applied to a one input terminal of a NAND-gate NAND. The 1 Hz signal of said dividing circuit 11 is applied to the other input terminal of the NAND-gate NAND via the AND-gate AND 1 which is switched to its generating state by the Q-output of said flip flop FF.

Numeral 16 is a shift register for controlling the display device 15 and for changing the counting contents of the counting circuit 12. The shift register is controlled by the signal by the ON-OFF operation of the selecting switch 6*a* and the signal is applied to the input side of the shift register 16 via the AND-gate AND 2 which is placed in its gating state by the Q-output [1] of said flip flop FF whereby the amending or correcting signals M, H and D representative of the minute, hour and date are produced from the output side of said shift register 16. The amending signals M, H and D are applied to the counting circuit 12 to accordingly modify the counting contents thereof in a manner well known without.

The signals generated by the ON-operation of the resetting switch 6*b* is applied to both the dividing circuit 11 and flip flop FF via to the reset terminal of the AND gate AND 3 which is placed in its grating state by the Q-output of said flip flop FF.

A description will not be given of the operation of the present invention:

When the safety switch 7 is opened or in the off condition as indicated in FIG. 2, the Q-output of the trigger flip flop FF is [0] whereby the output of the NAND-gate NAND is [1] . In this state the outputs from the decoder 13 are applied to the driving circuit 14 whereby the normal display data is displayed by the display device 15 as indicated in FIG. 1.

In the above state should the inadvertently operate operates the selection switch 6*a* or resetting switch 6*b*, the safety function is maintained due to the OFF condition of the AND gates 2 and 3 caused by the safety switch 7 being OFF so as to disenable the switches 6*a* and 6*b*.

When said safety switch 7 is closed or in the ON condition, the flip flop FF is reversed and the Q-output of flip flop FF becomes [1] and as a consequence, the 1 Hz signal from the dividing circuit 11 is gated through the gate AND 1 and appears at the output side of the NAND gate NAND thereby enabling the switches 6*a* and 6*b*. When output of the NAND gate NAND is therefore applied to the AND-gates of the decoder 13 causing the display of the display device 15 to its display mode and to flash once each second thereby indicating the ON condition of the safety switch 7 and the accompanying release of the safety function. The displaying contents or the memorizing contents are now able to change by the operation of the selecting switch 6a according to the ON-positions of the AND-gates AND 2 and AND 3 in dependance upon the actuation of the switches 6a and 6b.

When the safety switch 7 is in switched openidor returned to the OFF condition, the output of the flip flop FF is reversed whereby the Q-output becomes [0], the output of the NAND-gate NAND becomes [1], the dividing circuit 11 is reset and the display of the display device 15 is restored to the normal condition.

On the other hand, in the conventional timepiece, in case of accidently operating the safety switch, it is possible to operate the safety function again by the pushing operation of the resetting switch, however the second display is also changed by the actuation of the resetting switch.

According to the above embodiment of the present invention, the whole display of the display device 15 is flashed at the time of releasing the safety function, however, the invention is not limitted to the above noted embodiment and it is possible to attain the same object by flashing only one or some of the date, hour and minute display portions. Further it is possible to employ a separate display portion of indicating the safety released condition.

The means for indicating the safety released condition is not limited to the flashing system and, for example, the display condition may be indicated by the complete erased form of the display so as to distinguish from the normal state.

Further, it is possible to provide a multi-type switch having two functions to perform the functions of the safety switch and function switch 6 instead of the independent type switches as indicated in FIG. 1.

According to the present invention, the operator is informed of the safety released condition by the change of the display when the safety switch is accidently operated therefore it is possible to avoid inadvertent actuation of the external function switch.

According to the inventive construction, it is possible to simplify the safety switch and to obtain a relatively simple construction at lower cost.

We claim:

1. In an electronic timepiece of the type having an oscillator for generating a high frequency signal suitable as a time standard; circuit means including a multi-stage dividing circuit connected to receive signal for dividing it to a lower frequency time signal representative of a predetermined time function; display means responsive to the time signal for displaying in a normal display mode the time function represented thereby; and time-correcting means including a manually operable switch coacting with said circuit means for effecting correction of the displayed time function in response to operation of said switch, the improvement comprising: means including a manually operable safety switch for enabling said time-correcting means to effect a correction of the displayed time function when said safety switch is in one switching state and for disenabling said time-correcting means to render it ineffective to make a correction of the displayed time function when said safety switch is in another switching state; and means coacting with said circuit means whenever said safety switch is in said one switching state for changing the display mode of said display means to one other than said normal display mode thereby providing by the changing in display mode an indication that said time-correcting means is enabled to effect a correction of the displayed time function.

2. An electronic timepiece according to claim 1, wherein said means for changing the display mode of said display means comprises means for effecting flashing of at least part of the time function displayed by said display means whenever said safety switch is in said one switching state.

3. An electronic timepiece according to claim 2, wherein said means for effecting flashing of at least part of the time function displayed by said display means includes means for effecting the flashing at the rate of one flash per second.

4. In an electronic timepiece of the type having an oscillator for generating a high frequency signal suitable as a time standard; circuit means including a multi-state circuit connected to receive the high frequency signal for dividing it to at least lower frequency hour and minute drive signals; display means responsive to the hour and minute drive signals for displaying in a normal display mode the time in hours and minutes; and time-correcting means including a manually operable switch coacting with said circuit means for effecting correction of the time in response to operation of said switch, the improvement comprising means including a manually operable safety switch for enabling said time-correcting means to effect a time correction when said safety switch is in one switching state aand for disenabling said time-correcting means to render it ineffective to make a time correction when said safety switch is in another switching state; and means coacting with said circuit means whenever said safety switch is in said one switching state for changing the display mode of said display means to one other than said normal display mode thereby providing by the change in display mode an indication that said time-correcting means is enabled to effect a time correction.

5. An electronic timepiece according to claim 4, wherein said means for changing the display mode of said display means comprises means for effecting flashing of at least part of the time displayed by said display means whenever said safety switch is in said one switching state.

6. An electronic timepiece according to claim 5; wherein said means for effecting flashing of at least part of the time displayed by said display means includes means for effecting the flashing at the rate of one flash per second.

* * * * *